US012358594B2

(12) United States Patent
Rogers et al.

(10) Patent No.: US 12,358,594 B2
(45) Date of Patent: Jul. 15, 2025

(54) WATERCRAFT COVER

(71) Applicant: Polaris Industries Inc., Medina, MN (US)

(72) Inventors: Erik W. Rogers, Cadillac, MI (US); Michael T. Yobe, Knoxville, TN (US); David E. Baird, Marshfield, MO (US); Vicky L Null, Lebanon, MO (US); Mark R. McSorley, Lebanon, MO (US)

(73) Assignee: Polaris Industries Inc., Medina, MN (US)

( * ) Notice: Subject to any disclaimer, the term of this patent is extended or adjusted under 35 U.S.C. 154(b) by 439 days.

(21) Appl. No.: 17/879,989

(22) Filed: Aug. 3, 2022

(65) Prior Publication Data

US 2023/0038414 A1 Feb. 9, 2023

Related U.S. Application Data

(60) Provisional application No. 63/230,454, filed on Aug. 6, 2021.

(51) Int. Cl.
*B63B 17/02* (2006.01)

(52) U.S. Cl.
CPC ..... *B63B 17/02* (2013.01)

(58) Field of Classification Search
CPC ..... B63B 17/02; B63B 17/023
See application file for complete search history.

(56) References Cited

U.S. PATENT DOCUMENTS

| | | | | |
|---|---|---|---|---|
| 5,441,066 | A * | 8/1995 | Harris | E04H 15/28 135/98 |
| 8,616,511 | B2 | 12/2013 | James | |
| 8,950,416 | B1 | 2/2015 | Spellman | |
| 9,752,364 | B2 | 9/2017 | James | |
| 9,783,267 | B1 | 10/2017 | Alexander et al. | |
| 10,336,406 | B2 | 7/2019 | Alexander | |
| 10,858,769 | B2 * | 12/2020 | James | B63B 17/02 |
| 2009/0025769 | A1 * | 1/2009 | Buckley | E04H 15/46 135/140 |
| 2015/0166144 | A1 | 6/2015 | Langley | |
| 2015/0210150 | A1 | 7/2015 | Alexander | |
| 2018/0001965 | A1 | 1/2018 | Pisapia | |
| 2020/0324861 | A1 | 10/2020 | Mazzarelli | |
| 2022/0281560 | A1 * | 9/2022 | Rogers | B63B 17/02 |

FOREIGN PATENT DOCUMENTS

| | | | |
|---|---|---|---|
| CN | 210031616 | U | 2/2020 |
| KR | 20-2014-0000198 | U | 1/2014 |

* cited by examiner

*Primary Examiner* — Anthony D Wiest
(74) *Attorney, Agent, or Firm* — SCHWEGMAN LUNDBERG & WOESSNER, P.A.

(57) ABSTRACT

A cover for watercraft, such as pontoon boats, facilitates easy deployment and removal, as well as compact storage. The cover may be collapsed and deployed in a predetermined manner. The cover may include collapsible poles integrated with the cover fabric, which can be extended and retracted as the cover is deployed and collapsed. An arrangement of zippers and tensioners may be used to facilitate deployment securement and removal of the cover, as well as to facilitate access to at least a portion of the covered portion of watercraft while the cover is deployed.

19 Claims, 18 Drawing Sheets

WATERCRAFT COVER

CROSS REFERENCE TO RELATED APPLICATION

This application claims the benefit of U.S. Provisional Patent Application No. 63/230,454, entitled WATERCRAFT COVER and filed Aug. 6, 2021, the entire disclosure of which is incorporated herein by reference.

BACKGROUND

1. Technical Field

The present disclosure relates to covers for personal watercraft and, in particular, to covers for pontoon boats.

2. Description of the Related Art

Pontoon boats have two or more longitudinally extending floatation devices, or pontoons, which provide buoyancy sufficient to float the pontoon, a deck mounted atop the pontoons, associated boat equipment including seats and controls, and passengers and cargo. Pontoon boats are favored for their large deck areas, smooth ride, and suitability for shallow-water use, beach-docking capability, and general suitability for small lakes and rivers.

When not in use, pontoon boats may be covered to protect the deck, seats, console and other items from rain, debris and weather. However, such covers can be bulky and sometimes require significant effort to install and remove.

What is needed is an improvement over the foregoing.

SUMMARY

The present disclosure provides a cover for watercraft, such as pontoon boats, which facilitates easy deployment and removal, as well as compact storage. The cover may be collapsed and deployed in a predetermined manner. The cover may include collapsible poles integrated with the cover fabric, which can be extended and retracted as the cover is deployed and collapsed. An arrangement of zippers and tensioners may be used to facilitate deployment securement and removal of the cover, as well as to facilitate access to at least a portion of the covered portion of watercraft while the cover is deployed.

In one form thereof, the present disclosure provides a cover for a personal watercraft, the cover including a fabric sized to be received over a portion of the personal watercraft enclosed by a railing, a post coupled to an undersurface of the fabric at a cover/post connection, the post sized to extend from the undersurface to a supporting surface of a deck of the personal watercraft, and a tension assembly. The tension assembly includes a tension loop slideably coupled to the fabric and extending from the cover/post pivot connection to a periphery of the cover, and a tensioner fixed to the fabric and operable to tension the tension loop, such that actuation of the tensioner induces the fabric to tension around the post.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrates embodiments of the invention, the embodiments disclosed below are not intended to be exhaustive or to be construed as limiting the invention.

DETAILED DESCRIPTION

In the following detailed description, references are made to the accompanying drawings that form a part hereof, and in which are shown by way of illustrations specific embodiments or examples. These aspects may be combined, other aspects may be utilized, and structural changes may be made without departing from the present disclosure. Embodiments may be practiced as methods, systems or devices. Accordingly, embodiments may take the form of a hardware implementation, or an implementation combining software and hardware aspects. The following detailed description is therefore not to be taken in a limiting sense, and the scope of the present disclosure is defined by the appended claims and their equivalents.

Figure 1:
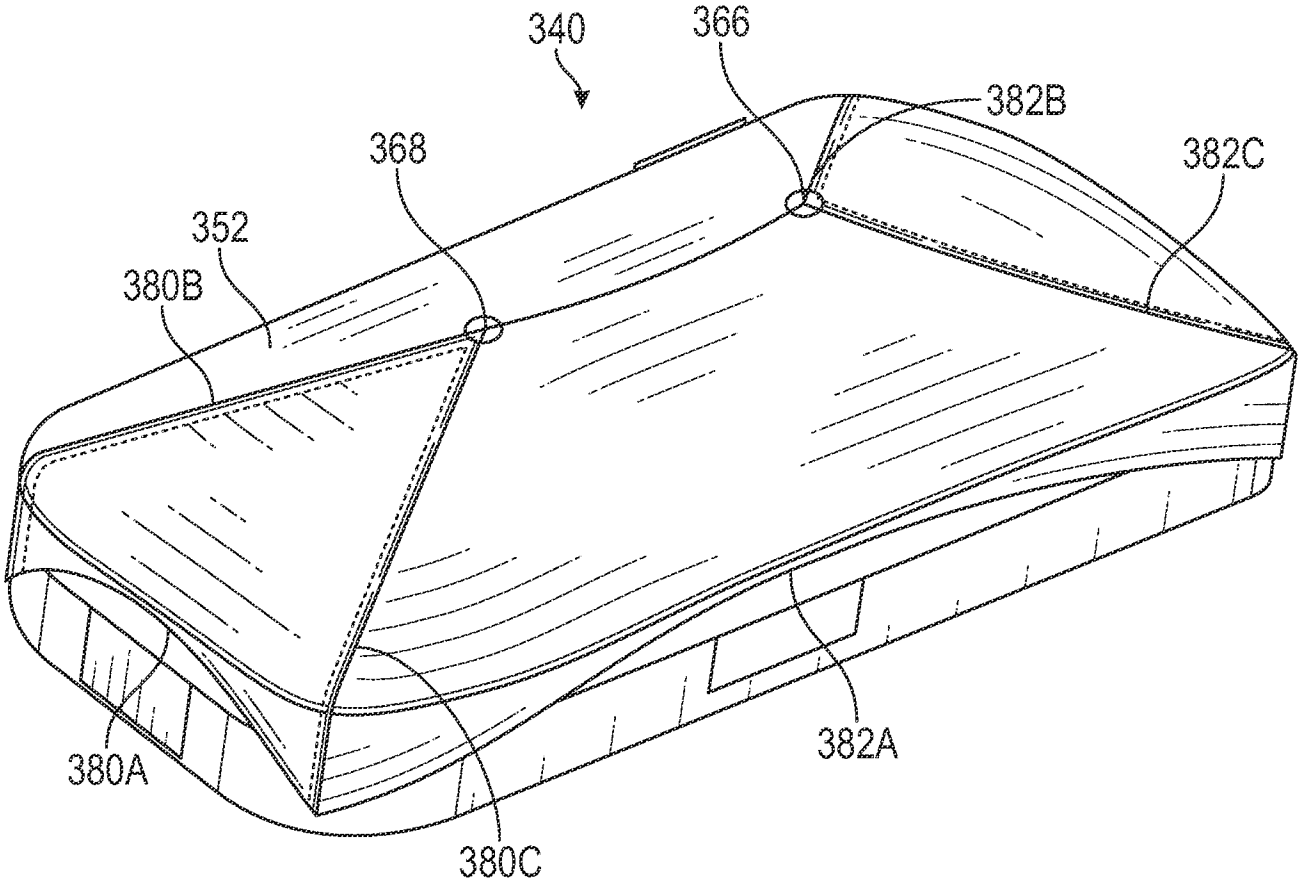
FIG. 1 is a starboard side, perspective schematic view of a portion of a watercraft having another cover made in accordance with the present disclosure mounted thereto.

Turning now to FIG. 1, watercraft 330 is a shown as a pontoon boat having at least two pontoons 332 mounted to a lower surface of deck 334. Pontoons 332 provide buoyancy for themselves, deck 334 and all the structures and equipment supported by deck 334, which may include a motor, seats, a console, and other equipment. The motor is mounted at the stern of watercraft 330 and controlled by the console, which is also used for controlling the direction of travel for watercraft 330 (e.g., by turning the motor about a vertical axis). In the illustrated embodiment, arch 338 extends upwardly from the port and starboard sides of watercraft 330 and may support a number of additional structures, such as canopies, speakers and the like. A railing 336 surrounds at least a portion of the outer periphery of the deck 334 to provide a secure interior space for passengers.

Watercraft 330 includes a cover assembly 340 which can be removably mounted to railing 336. In the illustrated embodiment, cover assembly 340 uses post assemblies 348 which can be retained in a designated position on the deck 334 to support the undersurface of the cover material or fabric 352. As further described below, cover 340 includes an arrangement of zippers, tensioners and other features which facilitate the deployment and stowage of cover 340 by a single operator with ease and efficiency.

Figure 2:
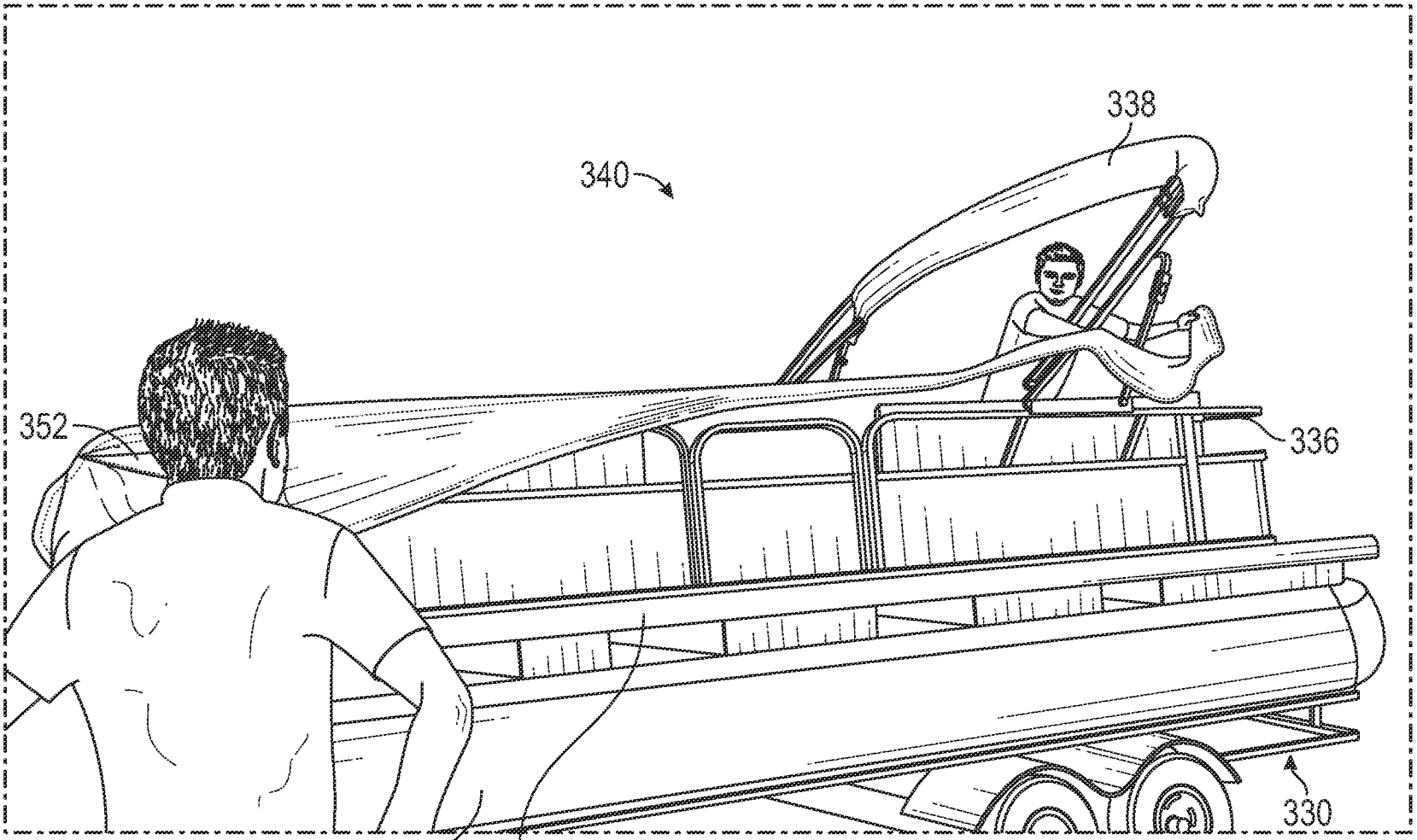
FIG. 2 is a port side, perspective view of a watercraft having another cover made in accordance with the present disclosure partially mounted thereto.
Figure 3:
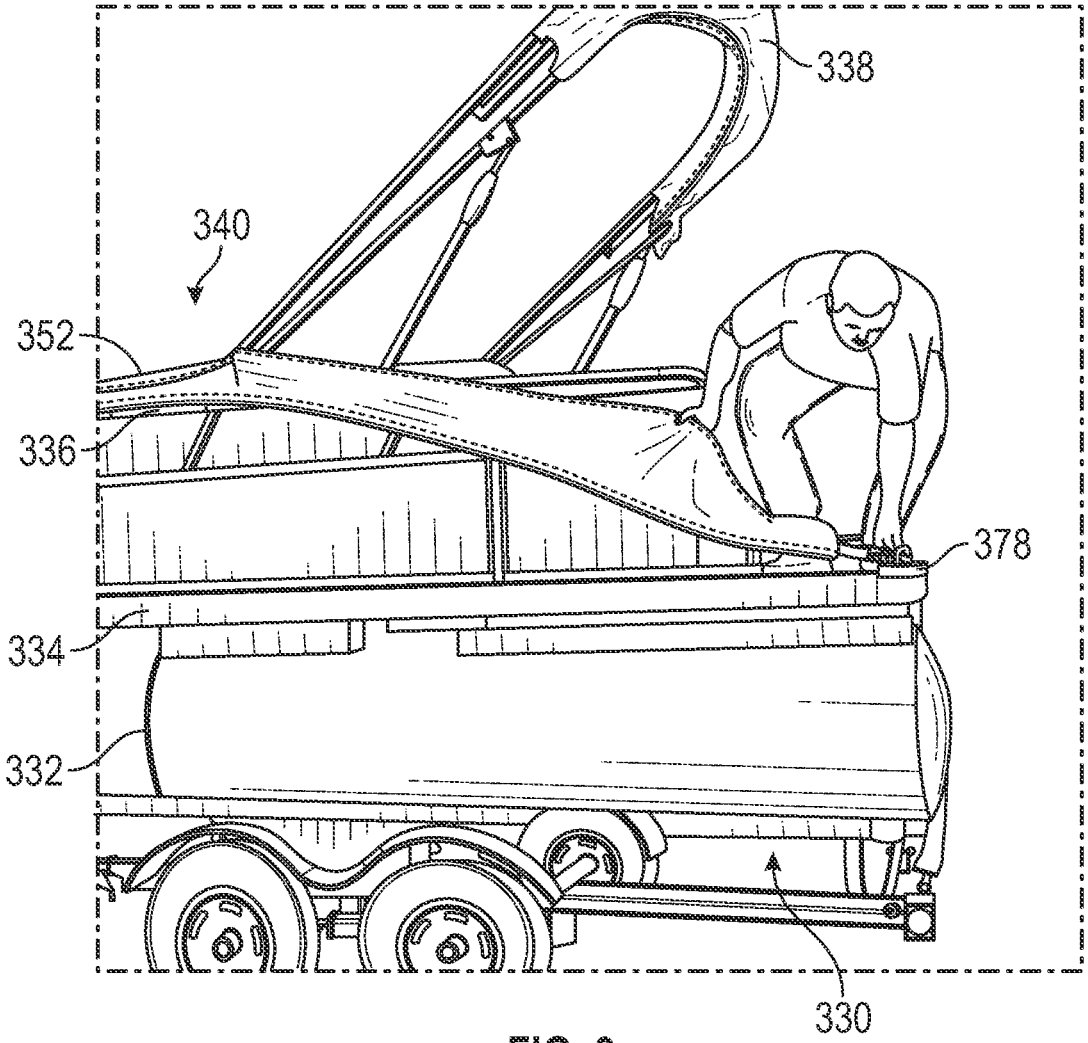
FIG. 3 is a port side, perspective view of the watercraft and cover of FIG. 2, illustrating attachment of the cover to a port/stern attachment point on the watercraft.
Figure 4:
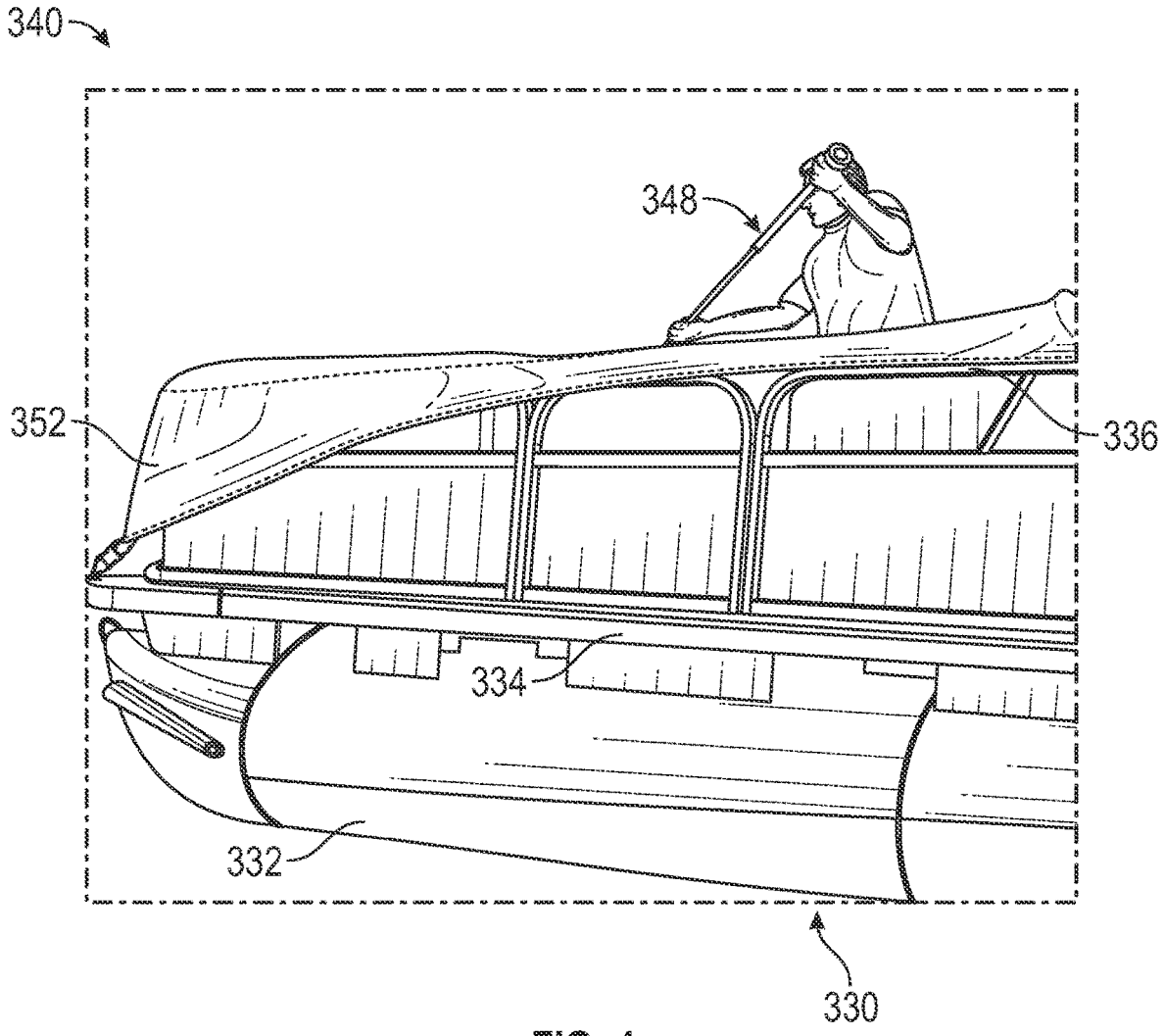
FIG. 4 is another view of the watercraft and cover of FIG. 2, showing deployment of a first support pole.

The features of cover 340 will be described by way of its method of installation to a watercraft, illustratively pontoon boat 330. Turning to FIGS. 2 and 3, the cover 340 is prepared for installation by first attaching one of the rear corners, such as the port-side rear corner, of the cover to attachment points fixed to deck 334 at the bow of watercraft 330. In one embodiment, the attachment points at all four corners of pontoon boat 330 are the same as attachment points 378 used at the stern, shown in FIGS. 3 and 13-16 and further described below. In one embodiment, the corners of cover 340 may include visual installation aids to allow the user to quickly identify the proper corner of the fabric 352 corresponding to a given corner of the watercraft 330. Such visual aids may include color-matched cover and boat corners (e.g., red for starboard, green for port, in accordance with standard boat lighting schemes), numbering, letters (e.g., "RF" for right-front, "LR" for left-rear, and so on), or other aids. The visual aids may include a "1" indicating that the first corner is a rear corner, then a "2" on the same side at the bow, a "3" at the other side of the bow, and finally a "4" on the other rear corner on the same side as "3." This allows a user to initially deploy the cover by walking just once around the periphery of the watercraft.

After connection to a first rear corner, the fabric 352 of cover 340 is drawn forwards toward the bow and over the adjacent port or starboard portions of railing 336 as shown in FIG. 2. A portion of the fabric 352 is passed outside of each adjacent upright of arch 338, while a rear access flap 372 (FIG. 12) remains inside of the uprights as further described below. The first bow corner is then attached to the corresponding port or starboard attachment point on the same side as the attached rear corner, followed by the other bow corner. In an exemplary embodiment, all attachment points 378 have an upstanding stud (or "button") with a flared upper end designed to receive and secure an attachment grommet secured to the corner of fabric 352 in the manner of a modified cleat. Further details of an exemplary attachment point 378 and corresponding attachment grommet can be found in U.S. Pat. No. 8,616,511, dated Dec. 21, 2013 and entitled APPARATUS AND METHOD FOR MOUNTING A BIMINI TOP, the entire disclosure of which is incorporated herein by reference. Both the starboard and port corners of cover 340 may be removably fixed to the stern portion of deck 334 in this manner.

With the first three corners of cover 340 now loosely attached to deck 334 of watercraft 330 and one of the stern corners still unattached, support post assemblies 348 are deployed. In the illustrative embodiment of FIG. 5, support post assembly 348 includes an upper pole section 350 and a lower pole section 351 pivotably connected to one another. Upper section 350 is pivotably connected at its free end to the undersurface of fabric 352 of cover 340, such as through the use of a pole retainer having a multiaxial joint such as a U-joint or pair of interconnected rings, similar to the connection between lower pole section 351 and footing assembly 354 shown in FIG. 8 and further described below. In the illustrated embodiment of FIG. 6, a forward cover/post pivot connection 366 may be accomplished such a multi-axial pivot connection. Connections 366 and 368 may also be made to a cover vent structure designed to allow some air to circulate under fabric 352 after deployment, but keep rain from entering.

The free end of lower section 351 is pivotably connected to post footing assembly 354, which is configured to removably attach to deck 334 as further described below. In an exemplary embodiment, post assembly 348 is permanently attached to fabric 352 such that post assembly 348 is an integral part of cover 340 and need not be separately connected to deploy cover 340.

Figure 5:
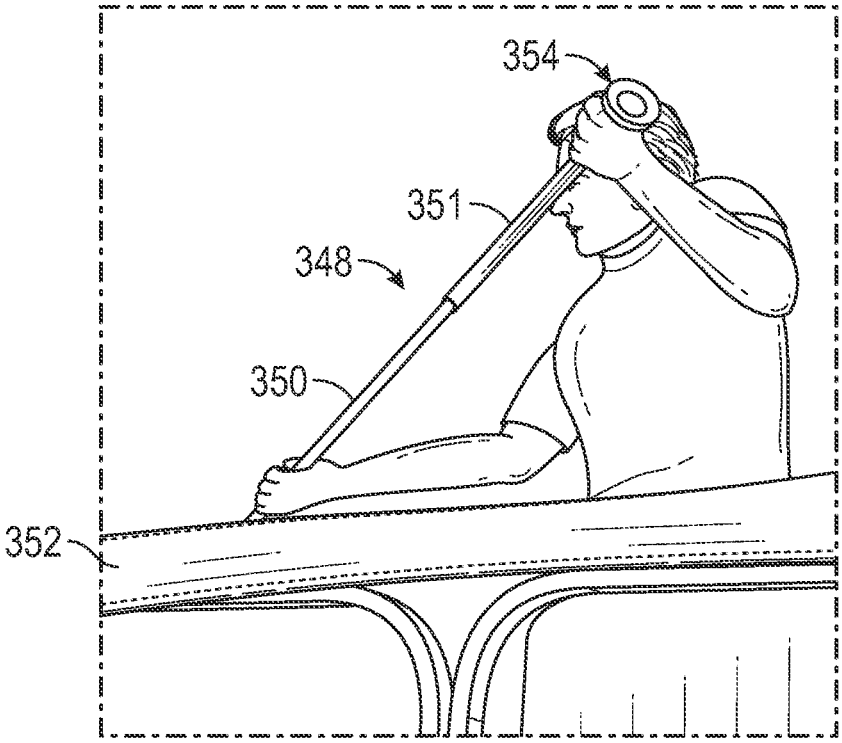
FIG. 5 is another view of the first support pole; shown in FIG. 4.
Figure 6:
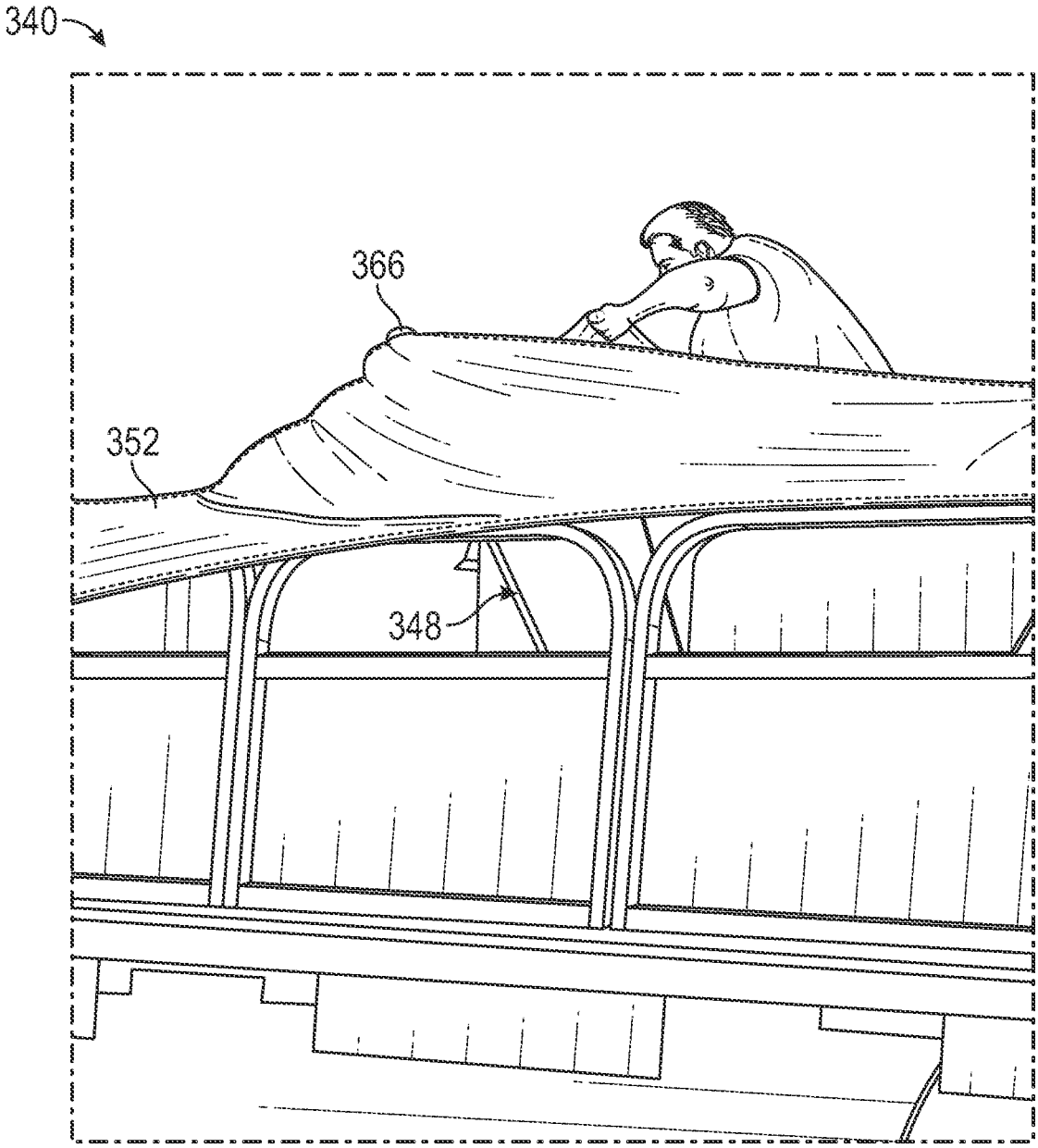
FIG. 6 is another view of the watercraft and cover of FIG. 3, showing attachment of a first support pole to a coupler attached to the watercraft.
Figure 7:
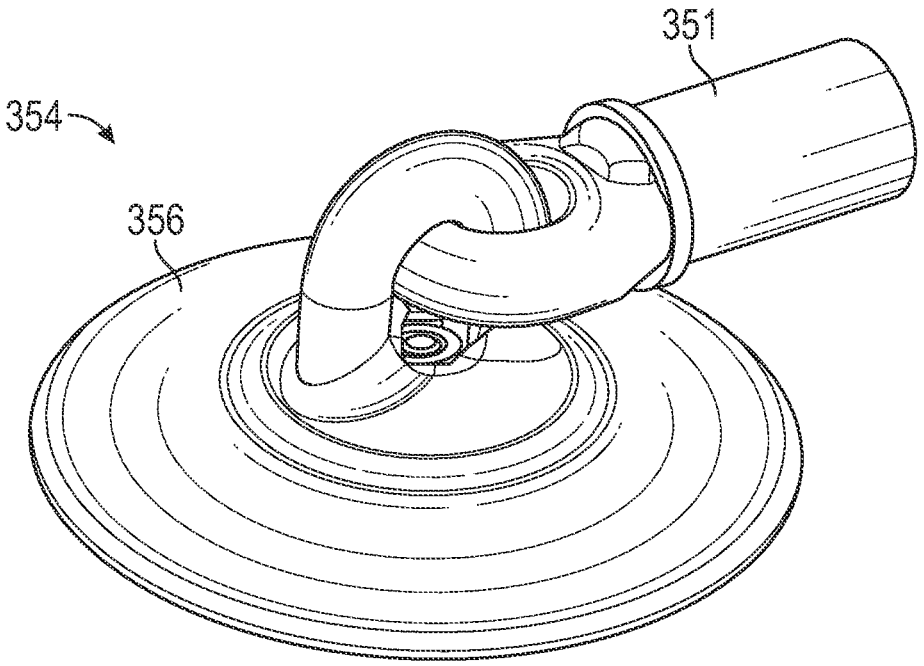
FIG. 7 is a perspective view of a pole footing for the support pole of FIG. 4.
Figure 8:
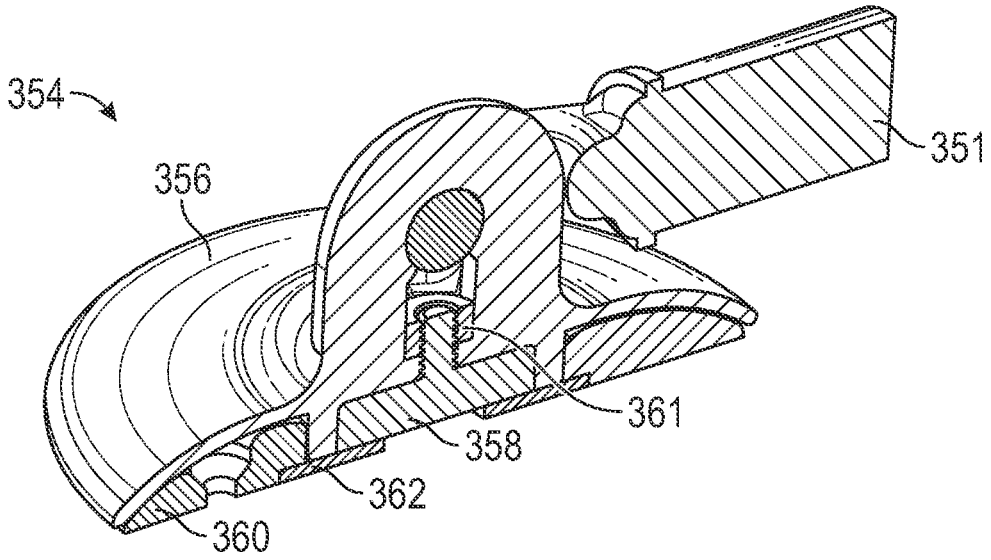
FIG. 8 is a perspective section view of the pole footing of FIG. 7 and the underlying coupler to which it attaches.

Upper section 350 and lower section 351 are first pivoted relative to one another and then locked into a substantially coaxial orientation, as shown in FIG. 5. Additional details of one exemplary locking pivot connection between upper and lower sections 350, 351 may be found in U.S. Pat. No. 9,752,364, dated Sep. 5, 2017 and entitled HINGE, the entire disclosure of which is incorporated herein by reference. Post assembly 348 is then pivoted under fabric 352 into a generally vertical orientation (FIG. 6), and footing assembly 354 is engaged. As shown in FIG. 8, footing assembly includes post locator 356 pivotably connected to the lower end of lower section 351. FIG. 7 illustrates a pair of rings interconnected to allow multiaxial pivoting between post locator 356 and section 351, though other multiaxial couplings, such as U-joints, may also be used. Fixed to an undersurface of post locator is a magnet 358, which may be threaded into a captive nut 361 as shown in FIG. 8.

Meanwhile, retainer 360 is fixed to an upper surface of deck 334 at a desired location. Retainer 360 holds a ferrous plate 362, which may be a large ferrous washer for example, at the desired location. As post assembly 348 is deployed, post locator 356 and magnet 358 are aligned with retainer 360. When an approximate alignment has been made, magnet 358 "snaps" into place in contact (or nearly in contact) with ferrous plate 362, and the annular cup-shaped cavity formed in the lower surface of post locator 356 nests with the corresponding annular cup shape of retainer 360 to position the lower end of post assembly 348 at the desired location.

Figure 9:
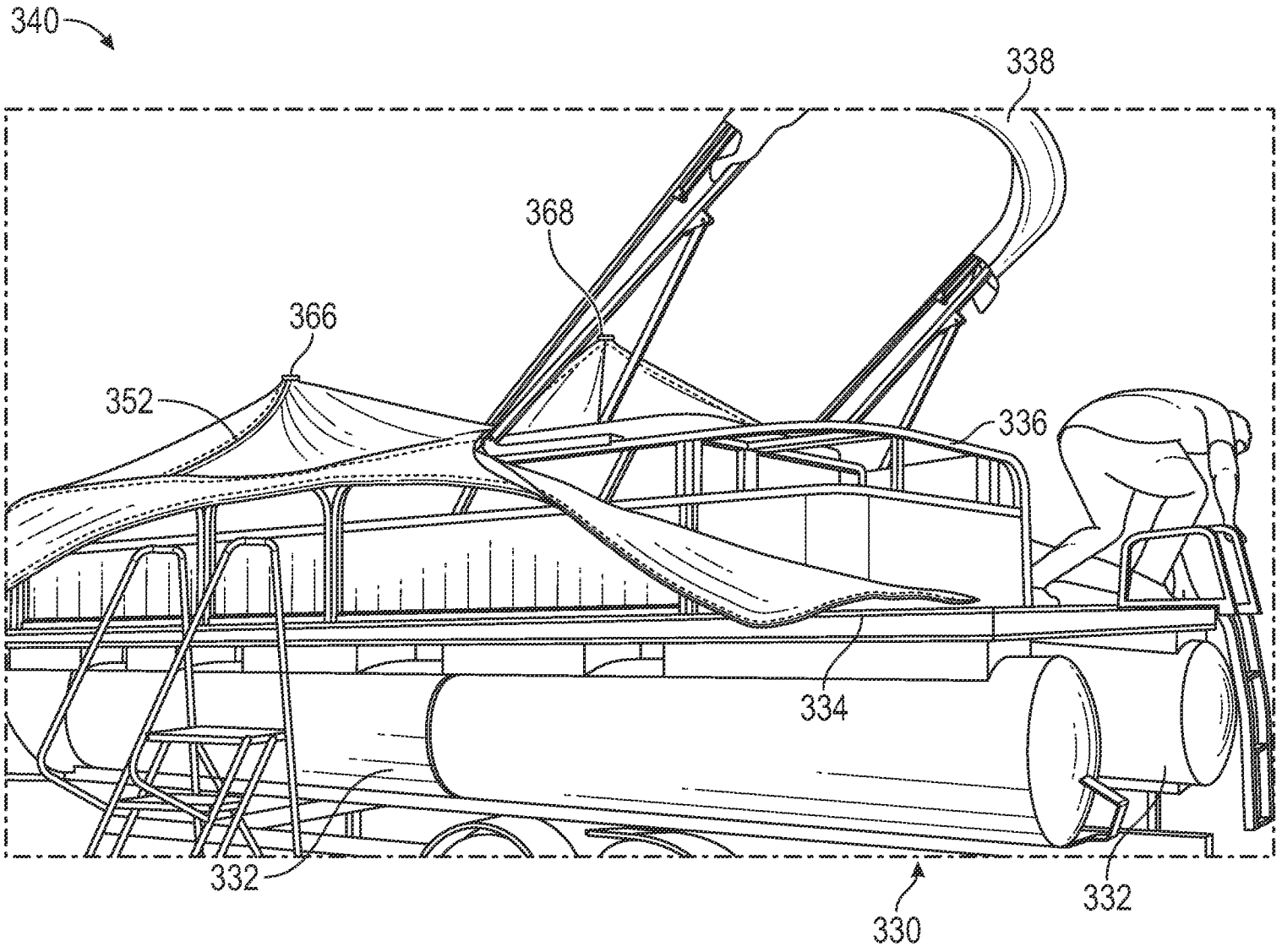
FIG. 9 is another view of the watercraft and cover of FIG. 2, illustrating attachment of the cover to a starboard/stern attachment point on the watercraft.
Figure 15:
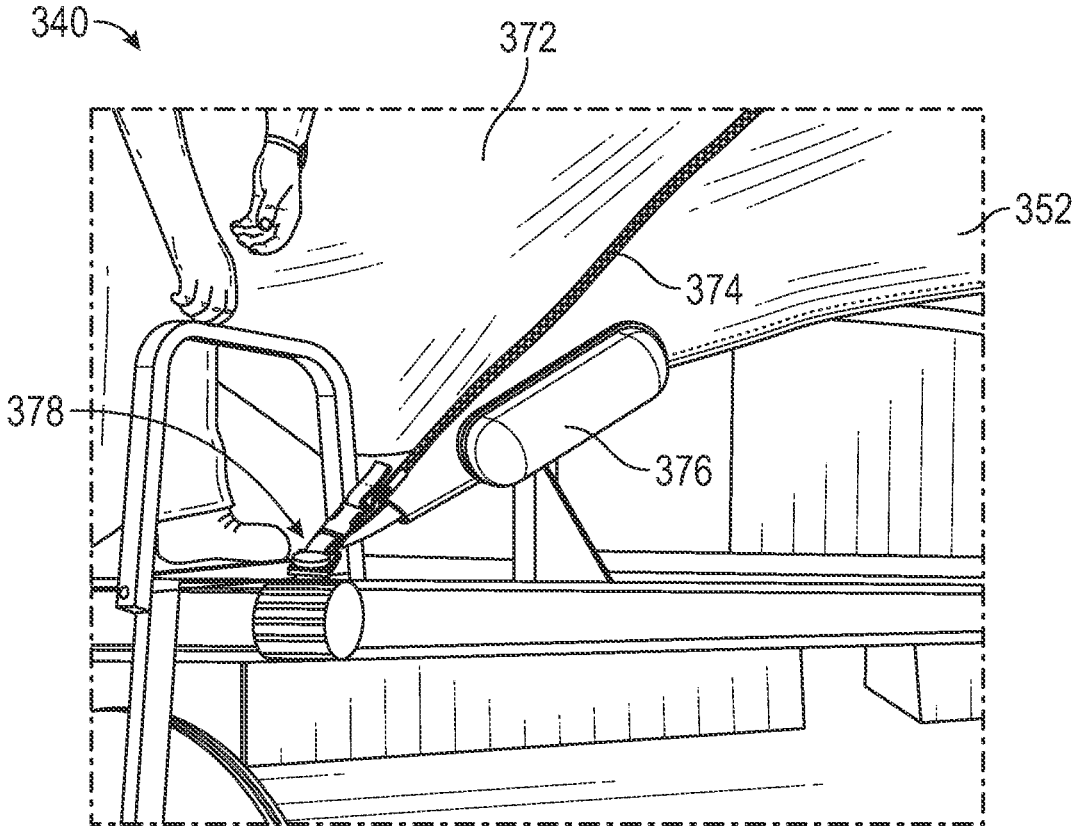
FIG. 15 is another view of the watercraft and cover of FIG. 13, illustrating completed connection of another zipper end to the starboard/stern attachment point on the watercraft.

In the illustrative embodiment of FIG. 9, watercraft 330 has a length between 15 and 25 feet, and therefore cover assembly 340 utilizes two post assemblies 348 with a first assembly connected to a forward cover/post pivot connection 366 and a second assembly 348 connected to an aft cover/post pivot connection 368. The installation process for the aft assembly 348 may be the same as the process for the forward assembly 348 described above with respect to FIGS. 4-8. In some embodiments, cover 340 may use only a single post assembly 348 (e.g., for shorter watercraft), while other embodiments may use three or more post assemblies 348 (e.g., for longer watercraft). Once all post assemblies 348 are in place, the other rear corner of cover fabric 352 (e.g., the rear-starboard corner) may be connected to the corresponding attachment point 378 (FIG. 15).

Figure 10:
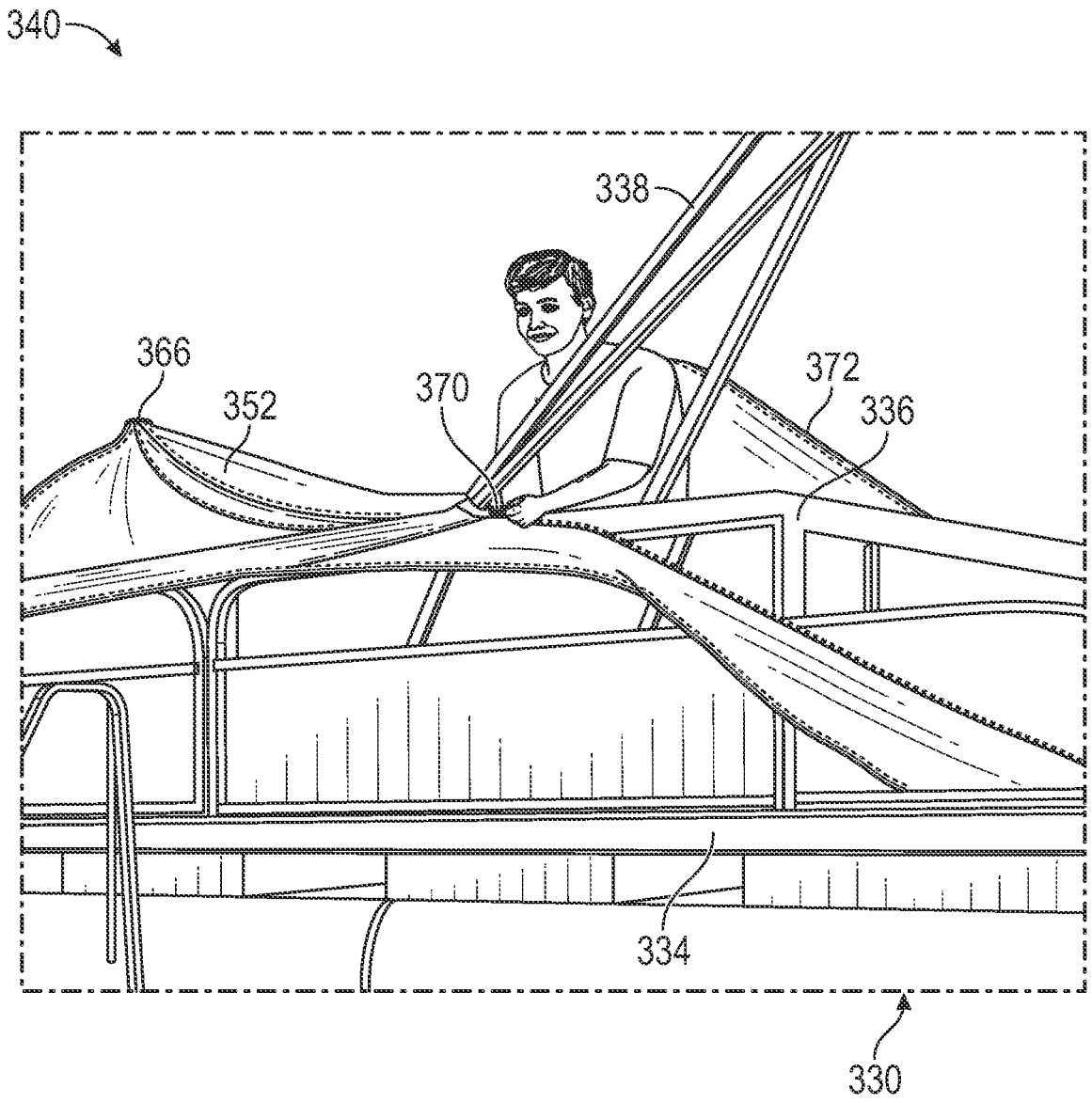
FIG. 10 is another view of the watercraft and cover of FIG. 2, illustrating initial deployment of an arch connecting portion of the cover.
Figure 11:
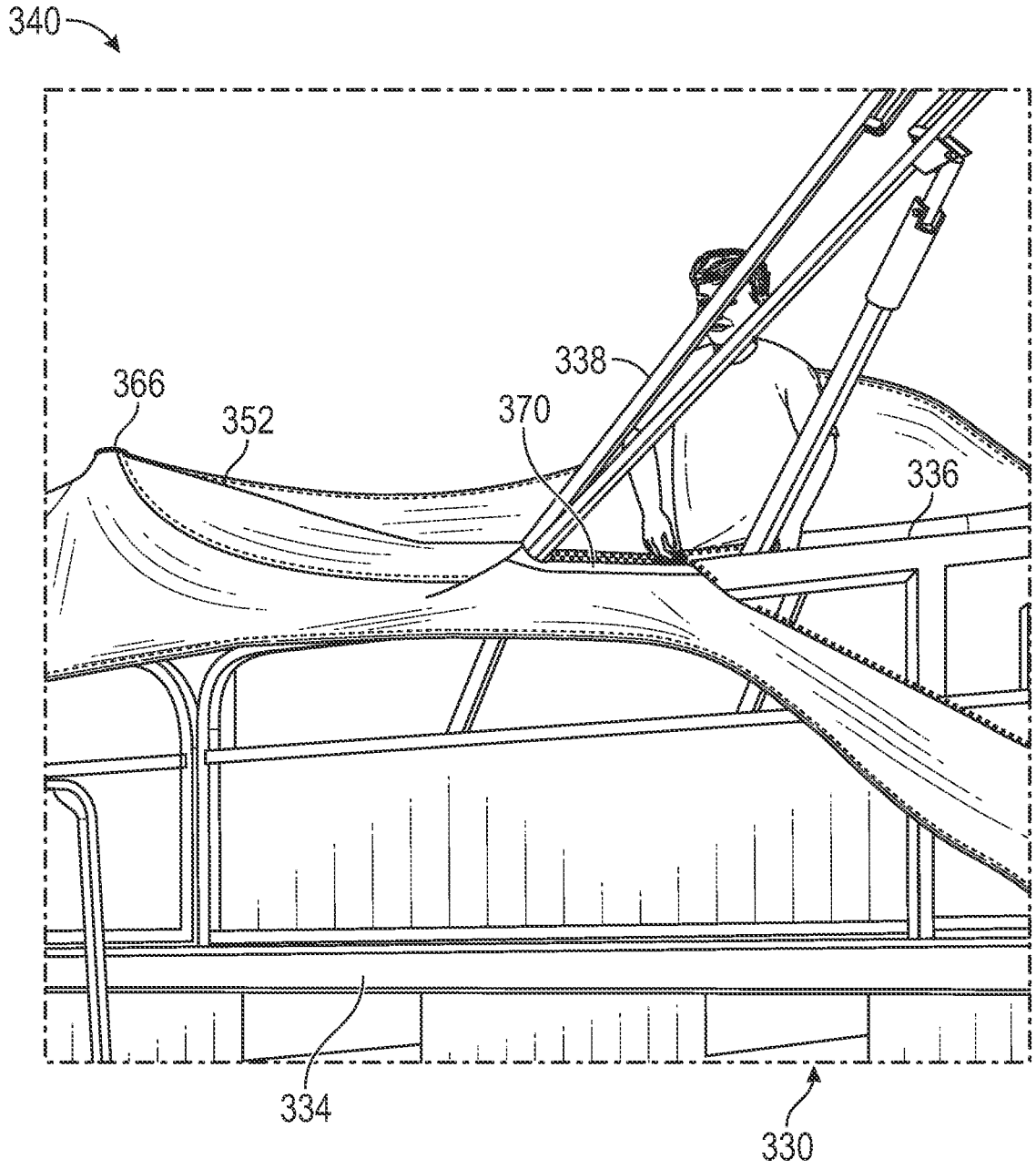
FIG. 11 is another view of the watercraft and cover of FIG. 10, illustrating further deployment of the arch connecting portion of the cover.

Turning to FIG. 10, cover assembly 340 includes a large rear access flap 372 which allows a user to access the interior portion of deck 334 circumscribed by railing 336 during the first steps of the deployment process described above. For example, rear access flap 372 may be placed aside to allow the user to easily access the undersurface of fabric 352 when deploying post assemblies 348. With post assemblies 348 deployed and the corners of cover 340 all secured, rear access flap 372 may be closed. As shown in FIG. 10, zipper 370 may be engaged to couple flap 372 to the port side portion of fabric 352, which was previously fixed to attachment 378 (FIG. 3) outboard of railing 336 and arch 338. The two halves of zipper 370 may be connected to one another just aft of the forward connection between arch 338 and railing 336 (FIG. 10), then zipped along railing 336 to the rear connection between arch 338 and railing 336 (FIG. 11). This creates a substantially waterproof seal capable of shedding rain and debris outside of railing 336.

Figure 12:
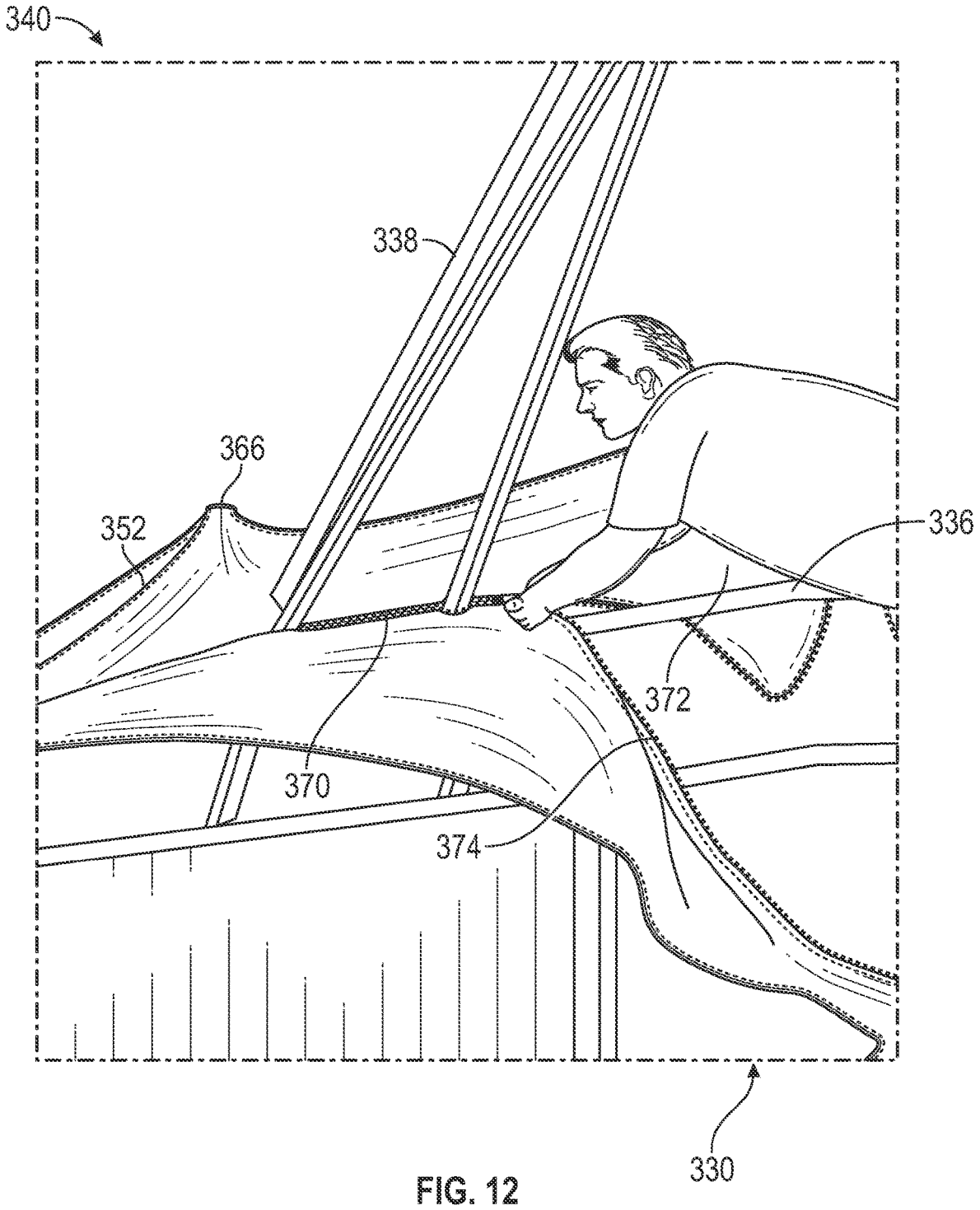
FIG. 12 is another view of the watercraft and cover of FIG. 10, illustrating completed deployment of the arch connecting portion of the cover.
Figure 13:
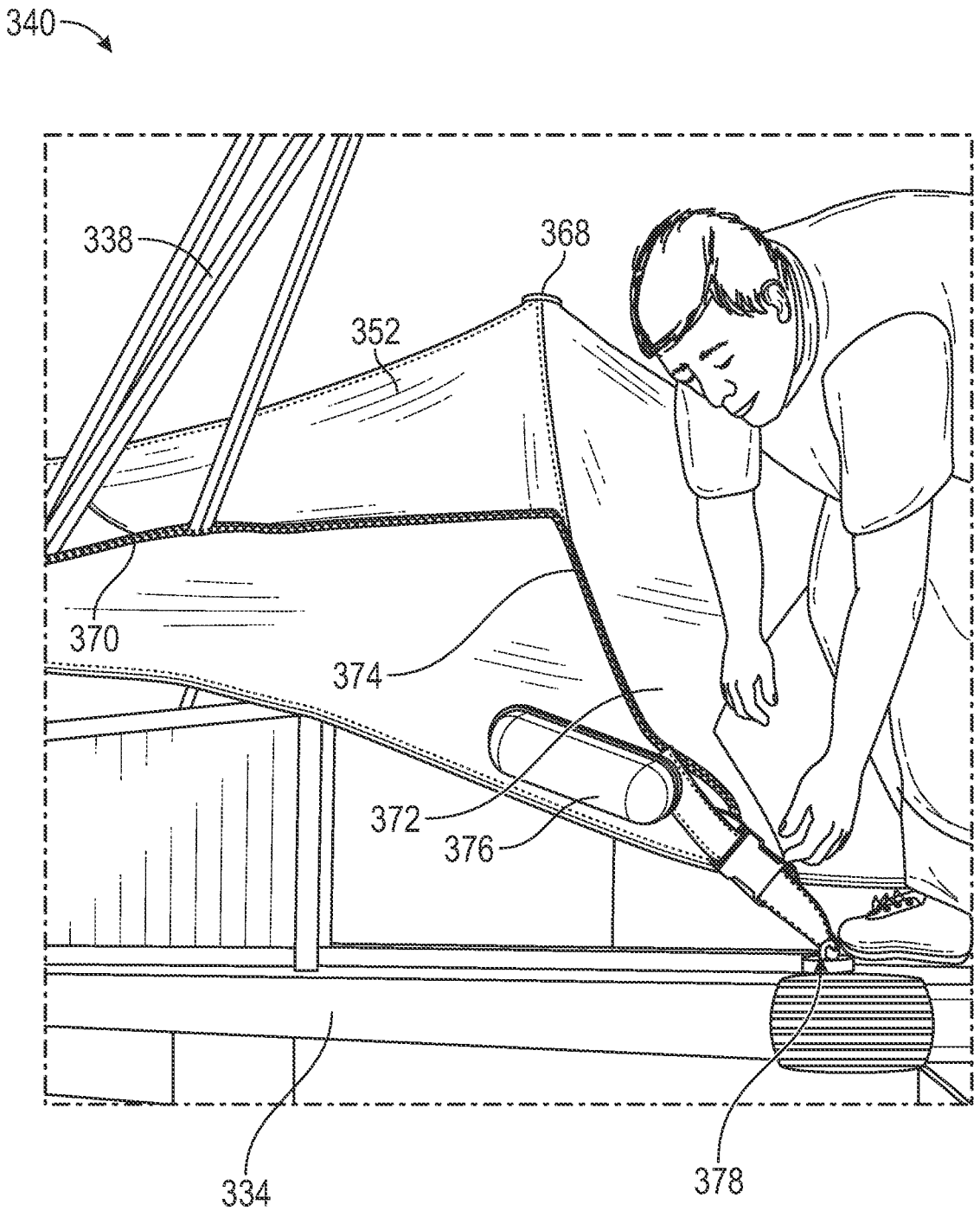
FIG. 13 is another view of the watercraft and cover of FIG. 2, illustrating connection of a zipper end to a port/stern attachment point on the watercraft.
Figure 14:
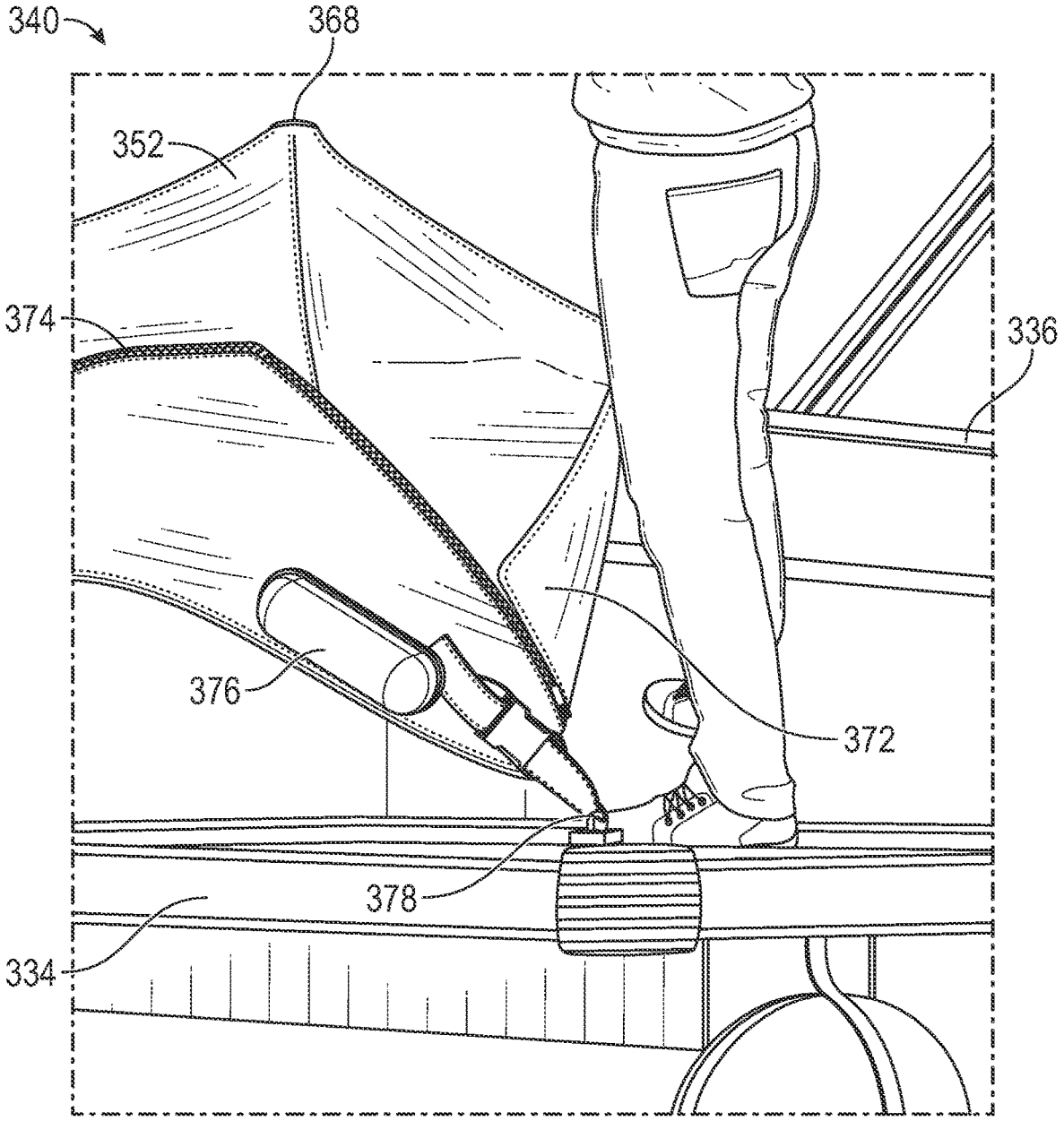
FIG. 14 is another view of the watercraft and cover of FIG. 13, illustrating completed connection of the zipper end to the port/stern attachment point on the watercraft.

A second port-side zipper 374 is then engaged between flap 372 and the adjacent outboard portion of fabric 352 just aft of the rear connection between arch 338 and railing 336 (FIG. 12). Zipper 374 is zipped shut, as shown in FIG. 13, such that the port side of railing 336 (FIG. 12) is completely covered. A second connection between the terminus of zipper 374 and attachment point 378 is made (i.e., in addition to the first connection made for the outboard portion of fabric 352, as described above). As best seen in FIG. 14, this second connection may be made with a side-release type buckle, though other couplings may be used as required or desired for a particular application.

Zippers 370 and 374 are also provided on the starboard side and deployed in the same manner. FIG. 15 illustrates a completed starboard-side cover deployment. Once this is done, the entire periphery of railing 336 is covered, such that rain and debris is shed outboard of railing 336 and the portion of deck 334 within railing 336 is kept dry, clean and protected from the sun by cover assembly 340.

Figure 16:
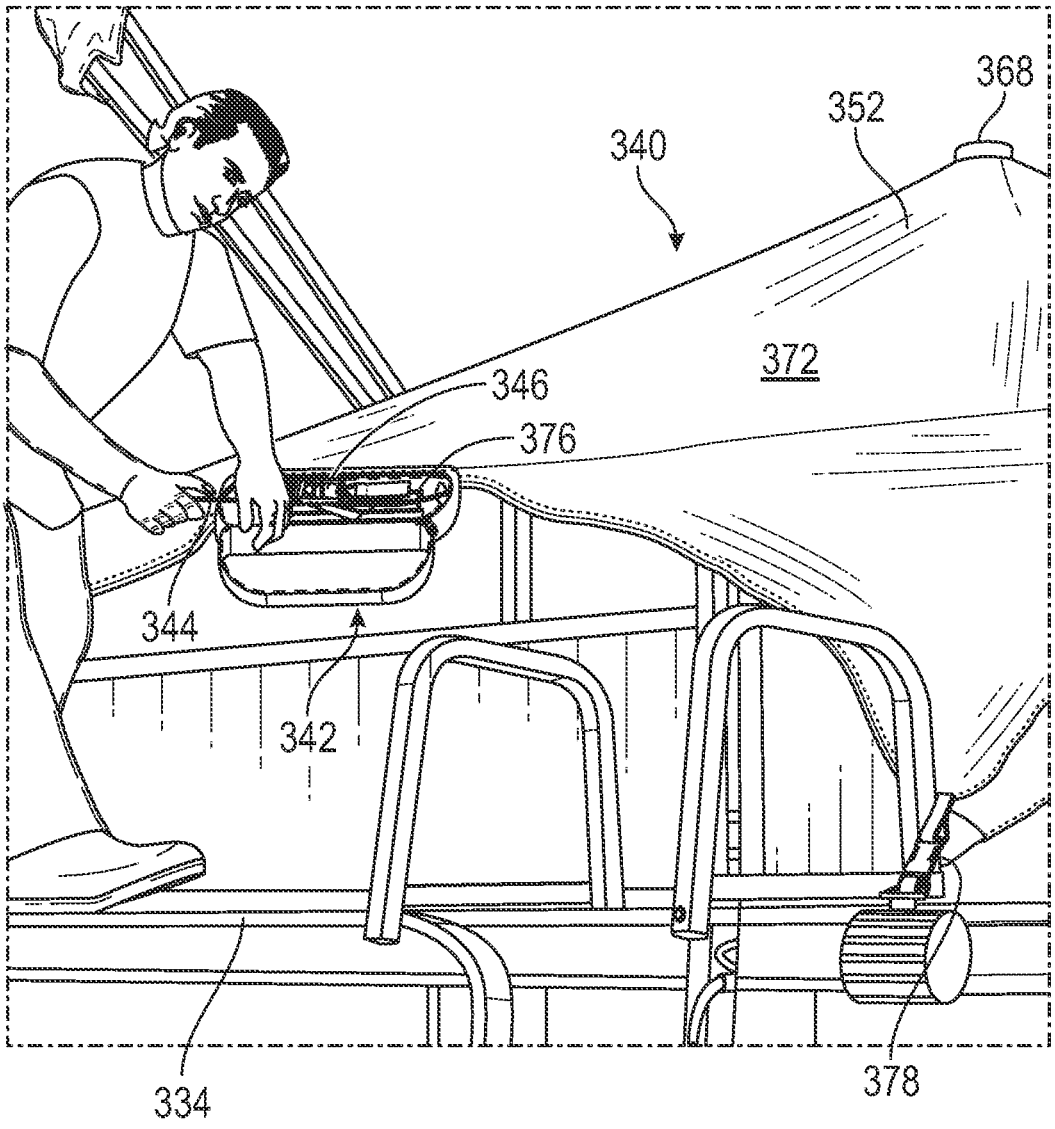
FIG. 16 is a stern perspective view of the watercraft and cover of FIG. 13, illustrating deployment of a first tensioner in a tension system.

In order to provide wind-resistance and prevent pooling of water at any part of cover assembly 340, fabric 352 may be pulled taut by an arrangement of tensioners. Referring now to FIG. 16, a first tension assembly 342 may be used to introduce tension in the rear portion of cover assembly around the aft post assembly 348, followed by tensioning of the front portion and around the forward post assembly 348 via at least one second tension assembly 342 as described below. The first tension assembly 342 is first removed from a protective pocket 376, which in the illustrated embodiment is a clamshell-type soft- or hard-shell container with a waterproof zipper closure. Contained in pocket 376 is a ratchet 346 with a toothed cable or strap 344 passing therethrough. Details of one exemplary tension assembly 342 including ratchet 346 and a toothed cable 344 can be found in U.S. Pat. No. 10,336,406, dated Jul. 2, 2019 and entitled TENSION HELD COVER, the entire disclosure of which is incorporated herein by reference.

Figure 17:
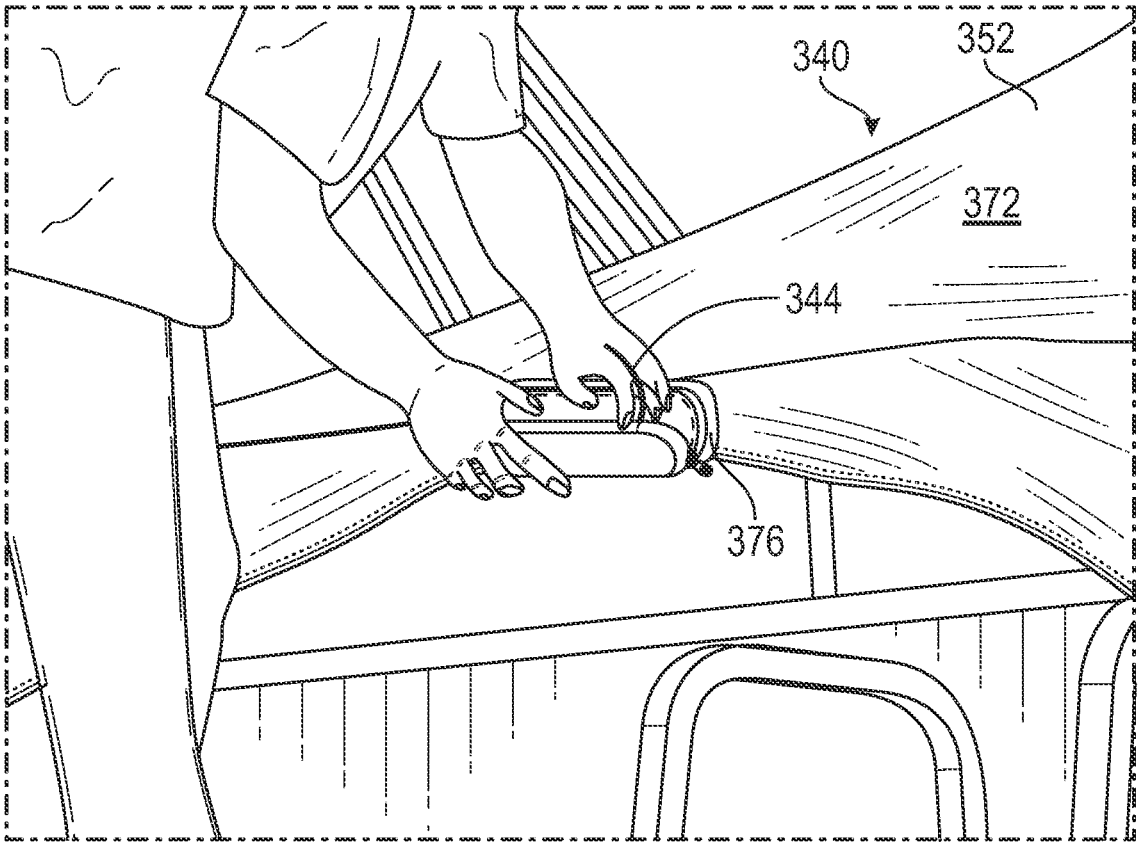
FIG. 17 is another stern perspective view of the watercraft and cover of FIG. 16, illustrating stowage of the first tensioner.

Referring still to FIG. 16, the user may first pull cable 344, which is allowed to pass freely through ratchet 346 in a tensioning or tightening direction, but not is a loosening direction while ratchet 346 is engaged. This takes up any initial slack in cable 344 quickly. Ratchet 346 is then actuated to take up additional slack with a mechanical advantage, thereby increasing the tension in cable 344 to any desired level. For the first tension assembly 342 positioned near the middle of the rear periphery of fabric 352, cable 344 provides tension in a loop comprising rear tension cable runs 380A, 380B and 380C (FIG. 1), through which cable 344 is slideably coupled to the fabric 352. This draws fabric 352 taut around the aft cover/post pivot connection 368. When tension in loop 380A, 380B and 380C has reached a desired level, ratchet 346 and the slack from cable 344 can be stowed in pocket 376 as shown in FIG. 17.

Figure 18:
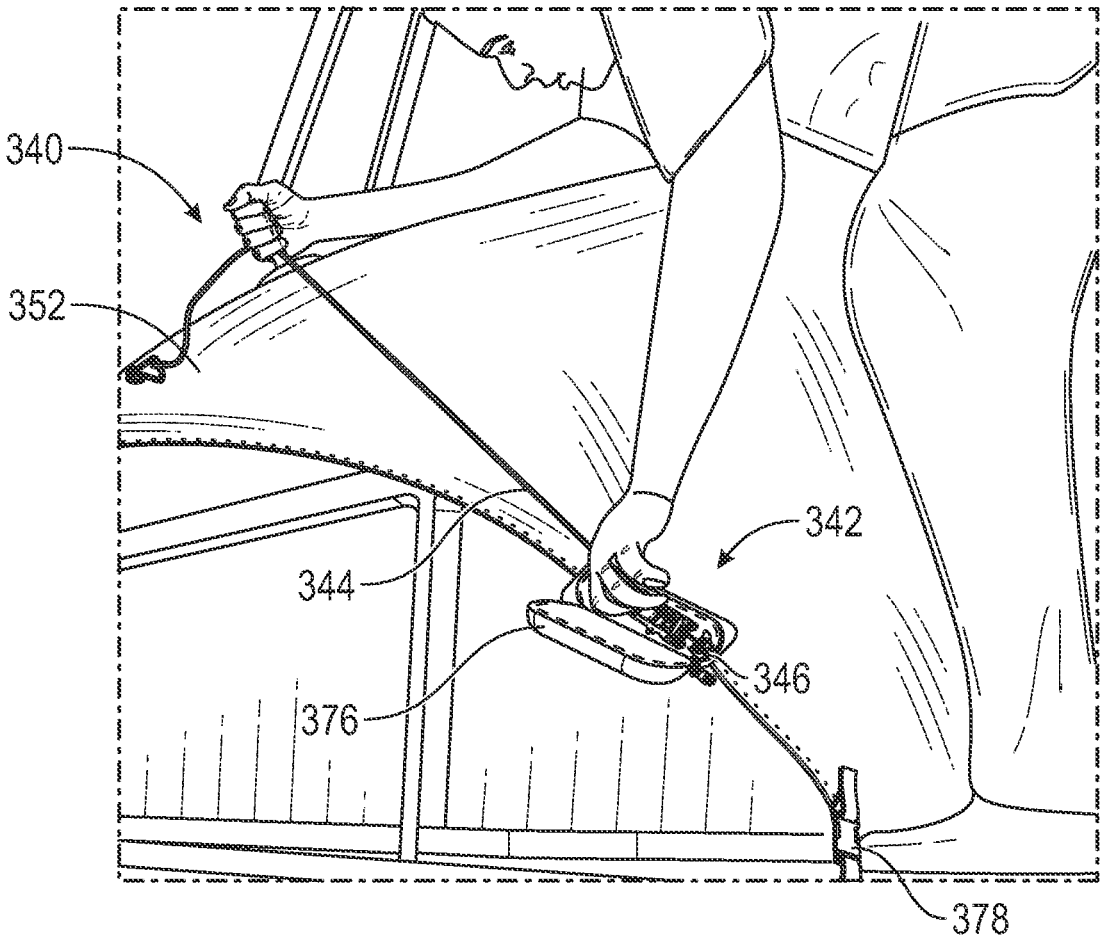
FIG. 18 is another stern perspective view of the watercraft and cover of FIG. 13, illustrating deployment of a second tensioner in the tension system.
Figure 19:
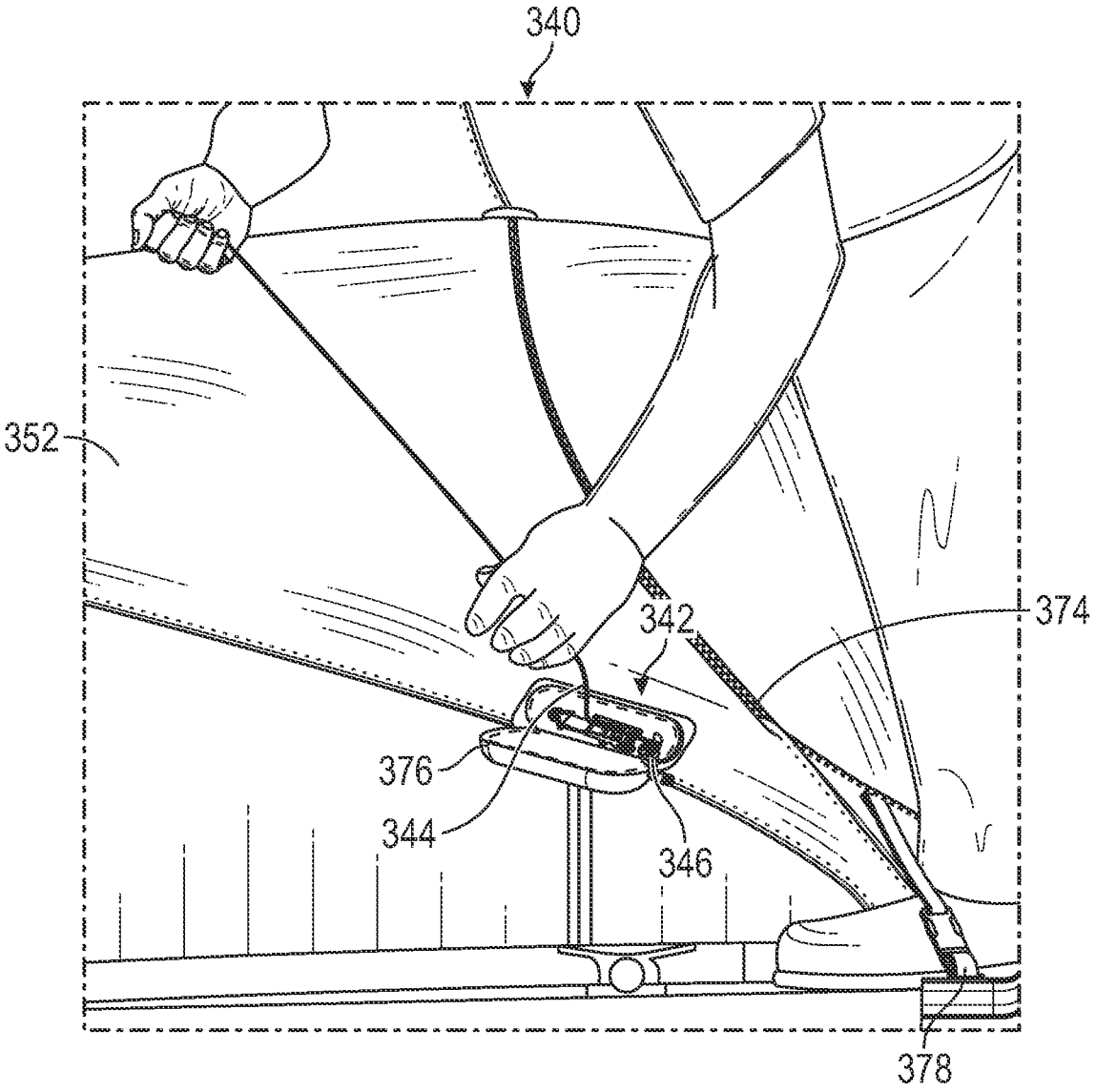
FIG. 19 is another stern perspective view of the watercraft and cover of FIG. 18, further illustrating deployment of the second tensioner.

The same process is implemented for additional tensioning assemblies 342, which in the illustrated embodiment are located at the port and starboard corners of the stern of deck 334. FIG. 18 illustrates the initial tensioning of cable 344 by pulling cable 344 through ratchet 346. Ratchet 346 is then used to provide for final tensioning (FIG. 19), and then ratchet 346 and the loose cable 344 may be placed in pocket 376 and secured with the zipper of pocket 376.

Each of these secondary tension assemblies operates on a forward tensioning loop including tension cable runs 382A, 382B and 382C (FIG. 1). Tension run 382A extends around the periphery of railing 336 along its starboard, port and forward portions. Tension runs 382B and 382C extend upwardly from the port and starboard forward corners of tension run 382A, respectively, to the forward cover/post pivot connection 366. When either of the secondary tension assemblies 342 is actuated in the same manner as discussed above with respect to the first tension assembly 342, the entire loop formed by tension cable runs 382A, 382B and 382C experiences an increase in tension. Although a single secondary tension assembly 342 would be sufficient to tension the entire forward loop, two tension assemblies 342 may be provided to promote fast, even and throughout tensioning throughout the forward tension loop.

The tension in throughout the fabric 352 of cover 340 provided by tension assemblies 342 pulls the fabric 352 taut around the periphery of railing 336, and around each of the pivot/post connections 366, 368. Advantageously, each post assembly 348 may pivot or rotate underneath fabric 352 as the tension increases, given that each post assembly defines a multi-axis pivot connection at its interface with deck 334 and with the undersurface of fabric 352. In particular, tension in the triangle formed between tension cable runs 382A, 382B and 382C may tend to pull the front post assembly 348 into a forward-leaning orientation, while tension in the triangle formed between cable runs 380A, 380B and 380C may tend to pull the rear post assembly 348 into a rearward-leaning orientation.

Advantageously, cover 340 as described herein is amenable to a fast deployment by a single individual. For example, a typical deployment time for a single individual using the illustrated cover 340 may be 5 minutes or less. This is attributed, in part to the self-contained nature of cover assembly 340—all parts and structures needed to fully deploy cover 340 are fixed to fabric 352 thereof, with no external poles, tensioners or other components. In addition attachments and tensioning structures of cover 340 can all be easily utilized by hand with no need for special tools, and without the need for the user to by physically underneath cover 340 at any point during the deployment.

Additionally, the provision of the rear access flap 372 (FIGS. 14 and 16) allows a user to access the rear area of the deck 334 even after the cover 340 is fully deployed and tensioned. The user can simply unclip the zippers 374 from the port and/or starboard attachment points 378 and unzip the zippers 374 to gain access to a substantial portion of the deck 334 without disrupting the tension in the other portions of the deployed cover 340.

While this invention has been described as having exemplary designs, the present invention may be further modified with the spirit and scope of this disclosure. Further, this application is intended to cover such departures from the present disclosure as come within known or customary practice in the art to which this invention pertains.

What is claimed is:

1. A cover for a personal watercraft, the cover comprising:

a fabric sized to be received over a portion of the personal watercraft enclosed by a railing;

a post coupled to an undersurface of the fabric at a cover/post connection, the post sized to extend from the undersurface to a supporting surface of a deck of the personal watercraft; and a tension assembly comprising:

a tension loop slideably coupled to the fabric and extending from the cover/post connection to a periphery of the cover and around at least a portion of the periphery of the cover, the tension loop comprising a cable; and a tensioner fixed to the fabric and operable to tension the cable in the tension loop, such that actuation of the tensioner induces the fabric to tension around the post.

2. The cover of claim 1, wherein the post comprises an aft post and the cover/post connection comprises an aft cover/post pivot connection, the cover further comprising a forward post coupled to the undersurface of the fabric at a forward cover/post pivot connection, the forward post sized to extend from the undersurface to the supporting surface of the deck of the personal watercraft.

3. The cover of claim 2, wherein the tension assembly further comprises:

a second tension loop slideably coupled to the fabric and extending from the forward cover/post pivot connection to the periphery of the cover and around at least a portion of the periphery of the cover; and a second tensioner fixed to the fabric and operable to tension the second tension loop, whereby actuation of the second tensioner induces the fabric to tension around the forward post.

4. The cover of claim 3, wherein the second tensioner is coupled to a first end of the second tension loop, the tension assembly further comprising a third tensioner coupled to a second, opposing end of the second tension loop.

5. The cover of claim 1, wherein the tensioner comprises:

a ratchet; and a toothed cable strap.

6. The cover of claim 5, further comprising a tensioner pocket sized to receive the ratchet and at least a portion of the toothed cable strap.

7. The cover of claim 1, further comprising at least four fastening grommets configured to be removably fixed to attachment points at four corners of the personal watercraft.

8. The cover of claim 1, wherein the cover/post connection defines a pivotable connection between the fabric and the post.

9. The cover of claim 1, wherein the post comprises a post footing assembly disposed at a lower end thereof, the post footing assembly configured to be removably coupled to the deck of the personal watercraft.

10. The cover of claim 9, wherein the post footing assembly includes a post locator and a magnet received in a cavity defined by a lower surface of the post locator.

11. The cover of claim 10, wherein the post footing assembly includes a ferrous plate fixable to the deck of the personal watercraft at a desired location, the ferrous plate magnetically engageable with the magnet when the post footing is in the desired location.

12. The cover of claim 11, wherein the post footing assembly includes a retainer fixable to the deck in the desired location over the ferrous plate to fix the ferrous plate in the desired location.

13. The cover of claim 12, wherein:

the cavity defined by the lower surface of the post locator includes an annular cup-shaped cavity; and the retainer is an annular shaped construct shaped to nest within the annular cup-shaped cavity.

14. The cover of claim 1, wherein the post comprises an upper pole section and a lower pole section pivotably joined to one another, the upper and lower pole sections pivotable with respect to one another.

15. The cover of claim 14, wherein the upper and lower pole sections are selectively lockable in a substantially coaxial orientation.

16. The cover of claim 1, wherein the fabric comprises a rear access flap selectively attachable to the rest of the fabric by at least one zipper, the rear access flap configured to be opened and closed while the tension assembly is engaged.

17. The cover of claim 16, further comprising at least four fastening grommets configured to be removably fixed to attachment points at four corners of the personal watercraft.

18. The cover of claim 17, wherein the at least one zipper comprises a clip configured to be connected to the adjacent attachment point independently of the adjacent fastening grommet, whereby the clip can be engaged to secure the at least one zipper in the closed configuration of the rear access flap.

19. The cover of claim 1, in combination with a pontoon boat comprising:

the deck;

at least two pontoons mounted to a lower surface of the deck; and a railing supported by the deck, the cover sized to be received over the railing.

* * * * *